US007567762B2

(12) United States Patent
Ogihara et al.

(10) Patent No.: US 7,567,762 B2
(45) Date of Patent: Jul. 28, 2009

(54) IMAGE FORMING APPARATUS CAPABLE OF DETECTING PAPER SKEW

(75) Inventors: Atsushi Ogihara, Kanagawa (JP); Hirofumi Goto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 443 days.

(21) Appl. No.: 11/451,451

(22) Filed: Jun. 13, 2006

(65) Prior Publication Data

US 2007/0104502 A1 May 10, 2007

(30) Foreign Application Priority Data

Nov. 7, 2005 (JP) ..... 2005-322227

(51) Int. Cl.
*G03G 15/00* (2006.01)
*G03G 15/16* (2006.01)

(52) U.S. Cl. ..... 399/18; 399/66; 399/397

(58) Field of Classification Search ..... 399/18, 399/313, 315, 322, 395, 397, 398, 400, 16, 399/66, 318

See application file for complete search history.

(56) References Cited

U.S. PATENT DOCUMENTS 5,041,850 A * 8/1991 Kahoyashi et al. ..... 347/157
5,101,239 A * 3/1992 Nishikawa et al. ..... 399/311
7,369,786 B2 * 5/2008 Nagasu et al. ..... 399/68

FOREIGN PATENT DOCUMENTS

| | | | |
|---|---|---|---|
| JP | 61198180 A | * | 9/1986 |
| JP | 03223049 A | * | 10/1991 |
| JP | 09288432 A | * | 11/1997 |
| JP | 10129890 A | * | 5/1998 |
| JP | 11322135 A | * | 11/1999 |
| JP | 2002244496 A | * | 8/2002 |
| JP | B2-3430782 | | 5/2003 |
| JP | B2-3559224 | | 5/2004 |

* cited by examiner

*Primary Examiner*—Robert Beatty
(74) *Attorney, Agent, or Firm*—Morgan, Lewis & Bockius LLP

(57) ABSTRACT

An image forming apparatus comprises an image forming portion that forms a toner image on an image carrying body, a transfer portion that transfers the toner image formed on the image carrying body to a recording medium, a detector that detects at least one of a skew and a passing position of the recording medium, and a controller that is provided downstream of the transfer portion in a recording medium transporting direction and controls at least one of the skew and the passing position of the recording medium according to a detection result by the detector.

21 Claims, 9 Drawing Sheets

DTS In/Out APPLIED VOLTAGE-PAPER OBLIQUE FEEDING (PAPER OF LENGTHWISE TEXTURE)

IMAGE FORMING APPARATUS CAPABLE OF DETECTING PAPER SKEW

CROSS-REFERENCE TO RELATED APPLICATION

This application claims priority under 35 USC 119 from Japanese Patent Application, No. 2005-322227, the disclosure of which is incorporated by reference herein.

BACKGROUND

1. Technical Field

The present invention relates to an image forming apparatus.

2. Related Art

In the image forming apparatus, after a toner image formed on a photosensitive body or an intermediate transfer body is transferred to a recording medium such as a recording paper with a transfer device such as a transfer roller, the toner image is fixed on the recording medium by heating and pressurizing with a fixing device. If the transferred recording paper is skewed or an entrance position of the recording medium to the fixing device is deflected from a predetermined position, the recording paper may be wrinkled when it is carried with a fixing roller or a fixing belt of the fixing device.

SUMMARY

According to an aspect of the present invention, an image forming apparatus includes an image forming portion that forms a toner image on an image carrying body, a transfer portion that transfers the toner image formed on the image carrying body to a recording medium, a detector that detects at least one of a skew and a passing height of the recording medium, and a controller that is provided downstream of the transfer portion in a recording medium transporting direction and controls at least one of the skew and the passing height of the recording medium according to a detection result by the detector.

BRIEF DESCRIPTION OF THE DRAWINGS

Embodiments of the present invention will be described in detail based on the following figures, wherein:

FIGS. 4A-4C show schematically a charge removal metal plate of an image forming apparatus according to a third exemplary embodiment of the invention, wherein FIG. 4A is a diagram showing a condition in which the charge removal metal plate is horizontal, FIG. 4B is a diagram showing a condition in which the IN side of the charge removal metal plate is in the vicinity of a recording paper, and FIG. 4C is a diagram showing a condition in which the OUT side of the charge removal metal plate is in the vicinity of the recording paper;

DETAILED DESCRIPTION

An image forming apparatus of a first exemplary embodiment of the invention will be described below.

Figure 1:
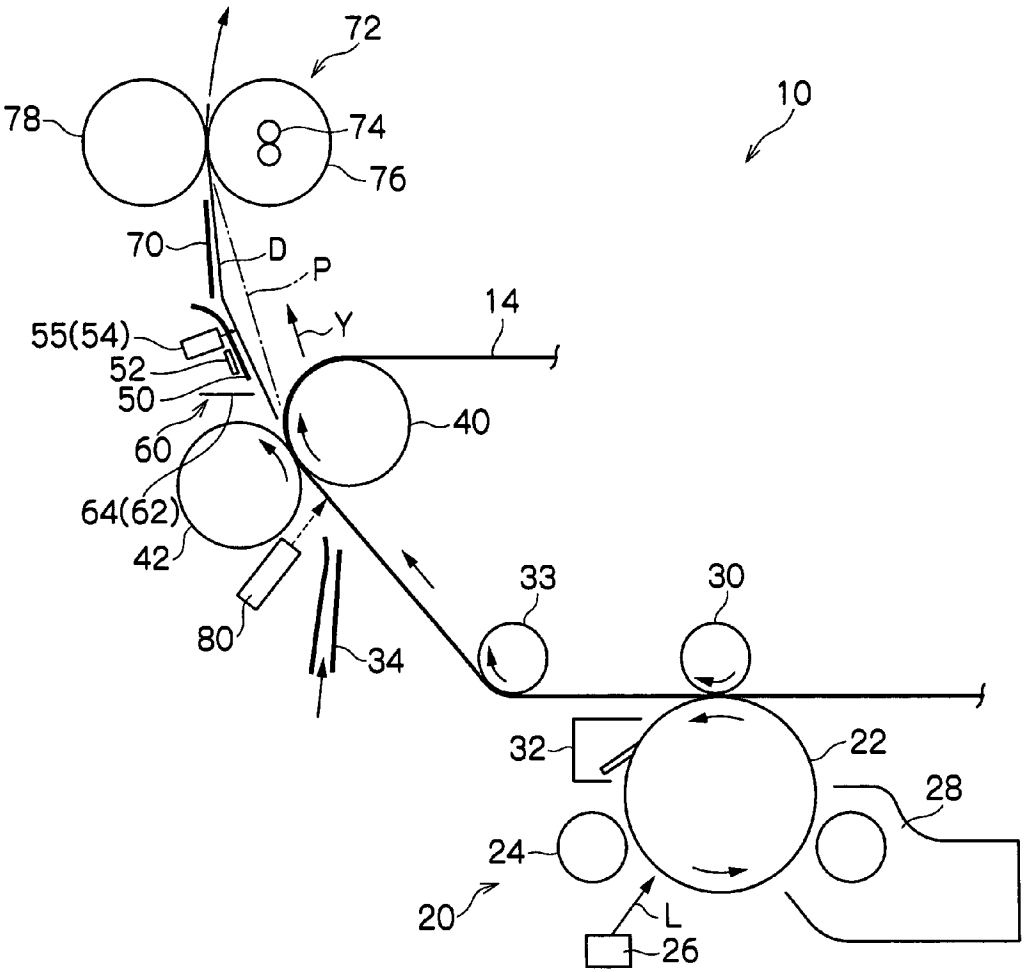
FIG. 1 is a partial side view schematically showing an image forming apparatus according to a first exemplary embodiment of the invention.

As shown in FIG. 1, the image forming apparatus 10 forms an image on a recording medium such as a recording paper P according to electrophotographic method. The entire image forming apparatus 10 is controlled by a control portion 12 (see FIG. 2) including a CPU, memory and the like.

The image forming apparatus 10 includes an endless band-like intermediate transfer belt 14 stretched over plural rollers 33 (only one of them is shown in FIG. 1) and a backup roller 40. The intermediate transfer belt 14 is driven by a drive roller (not shown). Further, the image forming apparatus 10 includes an image forming portion 20 for transferring a toner image to the intermediate transfer belt 14.

In the image forming portion 20, a drum-like electrophotographic exposure, that is, a photosensitive drum 22 is supported rotatably. The surface of the rotating photosensitive drum 22 is charged negatively by a charging device 24. The surface of the charged photosensitive drum 22 is exposed to light L corresponding to image information and emitted by an exposing device 26 so as to form an electrostatic latent image on the surface of the photosensitive drum 22. This electrostatic latent image is developed by a developing device 28 so as to form a toner image on the photosensitive drum 22. Then, the toner image is transferred to an intermediate transfer belt 14 by a primary transfer roller 30. Residual toner not transferred and left on the surface of the photosensitive drum 22 is cleaned by a cleaning device 32. Note that the polarity of toner is minus.

The image forming portions 20 are provided corresponding to each of the four colors, yellow, magenta, cyan and black, although not shown, and each image forming portion 20 transfers each color toner image onto the intermediate transfer belt 14 in succession so that respective color toner images are overlapped and consequently, a full-color toner image is formed on the intermediate transfer belt 14.

Figure 2:
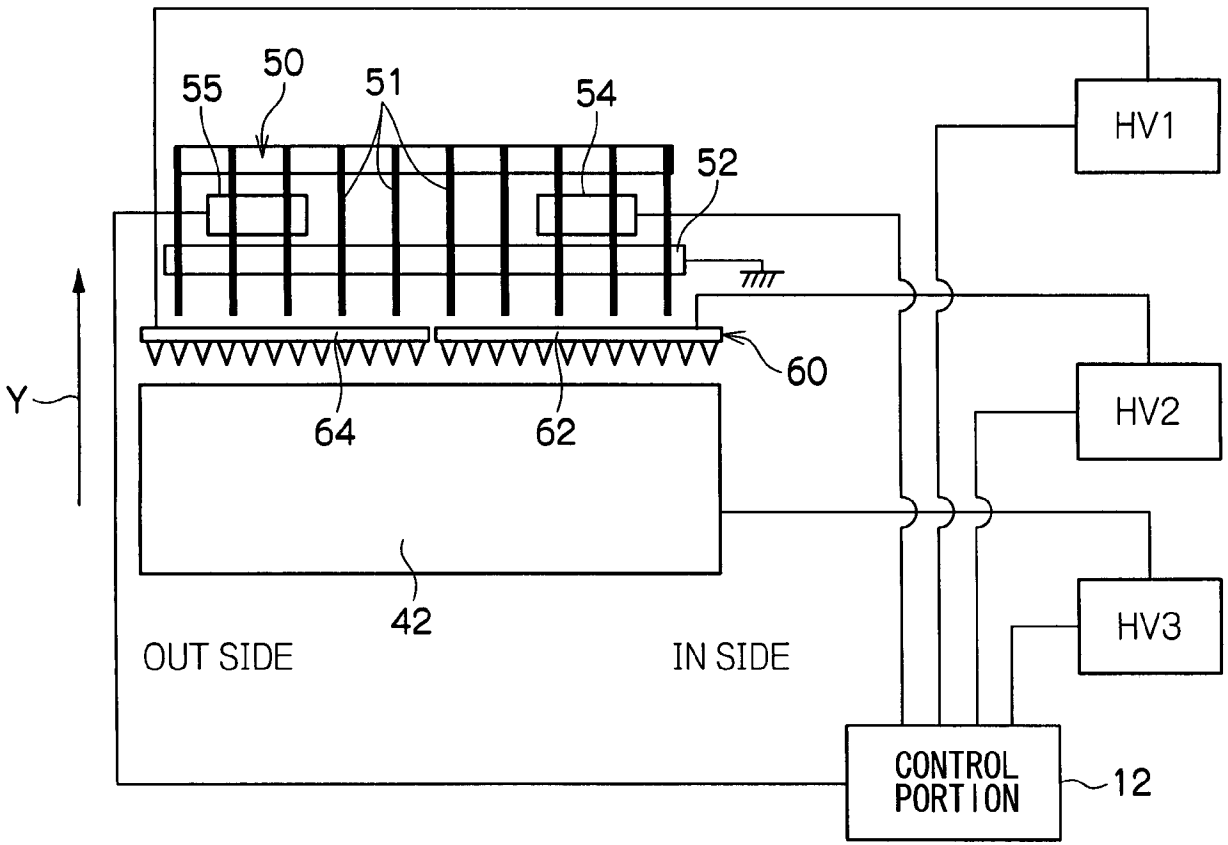
FIG. 2 is a front view showing schematically a separating mechanism of an image forming apparatus according to a first exemplary embodiment of the invention.

A secondary transfer roller 42 is provided at a position opposing the backup roller 40 wound with the intermediate transfer belt 14. As shown in FIG. 2, the secondary transfer roller 42 is applied with a predetermined voltage by HV3, which is a high voltage power source.

A recording paper P after being carried is guided by a shoot member 34 as shown in FIG. 1 and carried to a nipping portion formed by the secondary transfer roller 42 and the intermediate transfer belt 14 at an appropriate timing.

A full color image which is transferred from the aforementioned photosensitive drum 22 onto the intermediate transfer belt 14 is further transferred to the recording paper P when the recording paper P is passed between the secondary transfer roller 42 and the intermediate transfer belt 14. After the full color toner image is transferred, the recording paper P is carried to a fixing device 72 guided by guide members 50 and 70.

As shown in FIG. 2, a discharge separating mechanism 60 which is a separating portion is provided between the guide member 50 and the secondary transfer roller 42. In the discharge separating mechanism 60, saw-like needle-shaped discharge members 62, 64 that have pointed tips are arranged in line in the width direction of the recording paper P, that is perpendicular to the transporting direction of the recording paper P. Note that the needle-shaped discharge members 62, 64 are electrically insulated from each other. The pointed tip portions are discharged by being applied a predetermined voltage from HV1 HV2 which are high voltage power sources. Although the saw-like tips looks like to face in a downward direction of the image forming apparatus 10 in FIG. 2, actually, the tips point in a direction substantially perpendicular to the width direction of the recording paper P.

An arrow Y in each Figure indicates the direction of transporting the recording paper P. Further, it is assumed that the right side of FIG. 2 is IN side and the left side of FIG. 2 is OUT side with respect to the transporting direction of the recording paper P.

The guide member 50 is constituted of plural ribs 51 along the recording paper transporting direction and a charge removal metal plate 52 elongated in its width direction is disposed on the back side (on opposite to the side in which the recording paper P is carried) of the guide member 50. The charge removal metal plate 52 is grounded. The charge removal metal plate 52 may be grounded through a resistor or a capacitor. Alternatively, a predetermined voltage may be applied to the charge removal metal plate 52 without grounding.

The recording paper P after the toner image is transferred is separated from the intermediate transfer belt 14 due to the solidity of the recording paper P and discharge of the needle-shaped discharge members 62, 64 supplied with the predetermined voltage by the HV1, 2. Further, discharge occurs between the charge removal metal plate 52 and the recording paper P, so that the recording paper P is neutralized. Then, the recording paper is guided by the guide member 50 and the guide member 70 and carried to the fixing device 72.

As shown in FIG. 1, the fixing device 72 includes a heat roller 76 having a heat source 74 such as a halogen lamp internally and a pressurizing roller 78 making a pair with the heat roller 76. When the recording paper P is carried sandwiched between the heat roller 76 and the pressurizing roller 78, a full color toner image is fixed to the recording paper P by heat and pressure. Meanwhile, any one or both of the heat roller 76 and the pressurizing roller 78 may be constituted of a belt instead of a roller.

The transportation velocity at which the fixing device 72 carries the recording paper P is slightly lower than the transportation velocity at which the secondary transfer roller 42 and the nipping portion of the intermediate transfer belt 14 carry the recording paper P.

An image density detecting sensor 80 capable of measuring the density of a toner image on the intermediate transfer belt 14 is provided between the shoot member 34 and the secondary transfer roller 42. The control portion 12 controls the developing device 28 and the exposing device 26 depending on a detection result of the image density detecting sensor 80 so as to control the density of the image.

Jam detecting sensors 54, 55 for detecting the position of the lead edge of the recording paper P are provided on the back (opposite to a side in which the recording paper P is carried) of the guide member 50. As shown in FIG. 2, the jam detecting sensors 54, 55 are disposed at locations (IN side and OUT side) which correspond to both ends in the width of the carried recording paper. The control portion 12 determines that jam has occurred unless the jam detecting sensors 54, 55 detect the lead edge of the recording paper P after reaching a predetermined timing.

Next, the operation of this exemplary embodiment will be described.

In a image forming process, when the recording paper P passes the nipping portion between the secondary transfer roller 42 and the intermediate transfer roller 14 and a full color toner image is transferred to the recording paper P (referred as 'after an image is transferred' hereunder), in a case that the recording paper P is fed obliquely, a transportation failure such as jam is likely to occur. In addition, when a toner image is fixed by the fixing device 72 on the recording paper P which is fed obliquely or whose lead edge in the transporting direction into the fixing device 72 is not horizontal, the recording paper P may be wrinkled.

The recording paper P is fed obliquely or the entry position of the recording paper P into the fixing device 72 is not horizontal after an image is transferred because the recording paper P is carried with different friction resistances between the IN side and OUT side with respect to the guide member 50, or the recording paper P is carried without contacting to the guide member 50 (refer to virtual line in FIG. 1) due to the kind, thickness, solidity or the like of the recording paper P. Accordingly, the recording paper P may enter into the fixing device 72 unstably.

Figure 8:
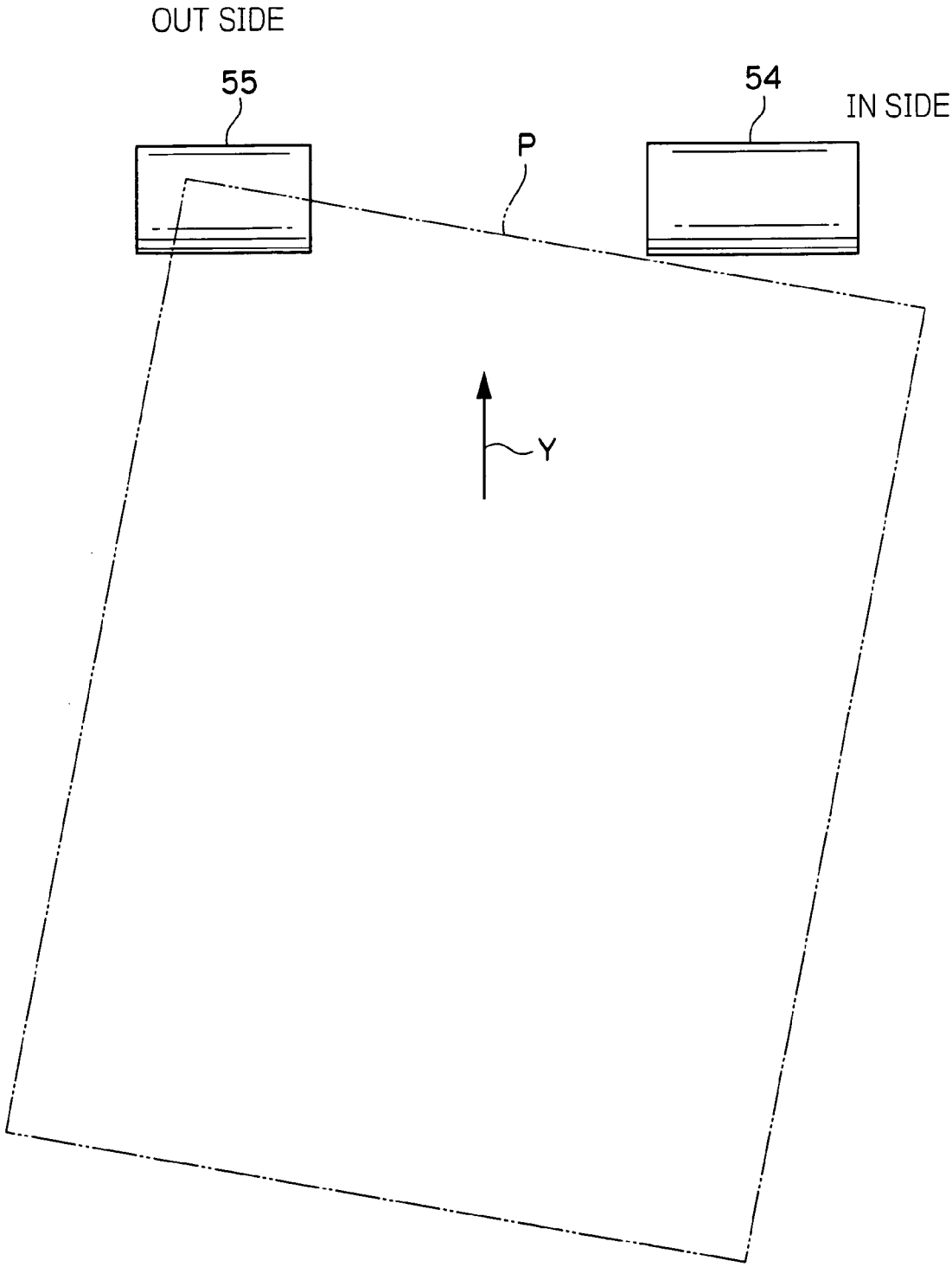
FIG. 8 is a diagram showing schematically a condition of detecting a skew of a recording paper with a jam detecting sensor.

If the recording paper P is fed obliquely as shown in FIG. 8, timings of detecting the recording paper P are slightly different between the jam detecting sensor 54 on the IN side and the jam detecting sensor 55 on the OUT side. In case of FIG. 8, the velocity on the OUT side is high while that on the IN side is low (the skew of the recording paper P is represented exaggeratingly in order to facilitate understanding). Thus, the control portion 12 acquires an amount of the skew of the recording paper P from a difference in the detecting timings.

By controlling the voltages applied to the needle-shaped discharge member 62 on the IN side and the needle-shaped discharge member 64 on the OUT side, the different separation forces with respect to the recording paper P are applied between the IN side and the OUT side so as to modify the skew of the recording paper P.

Figure 9:
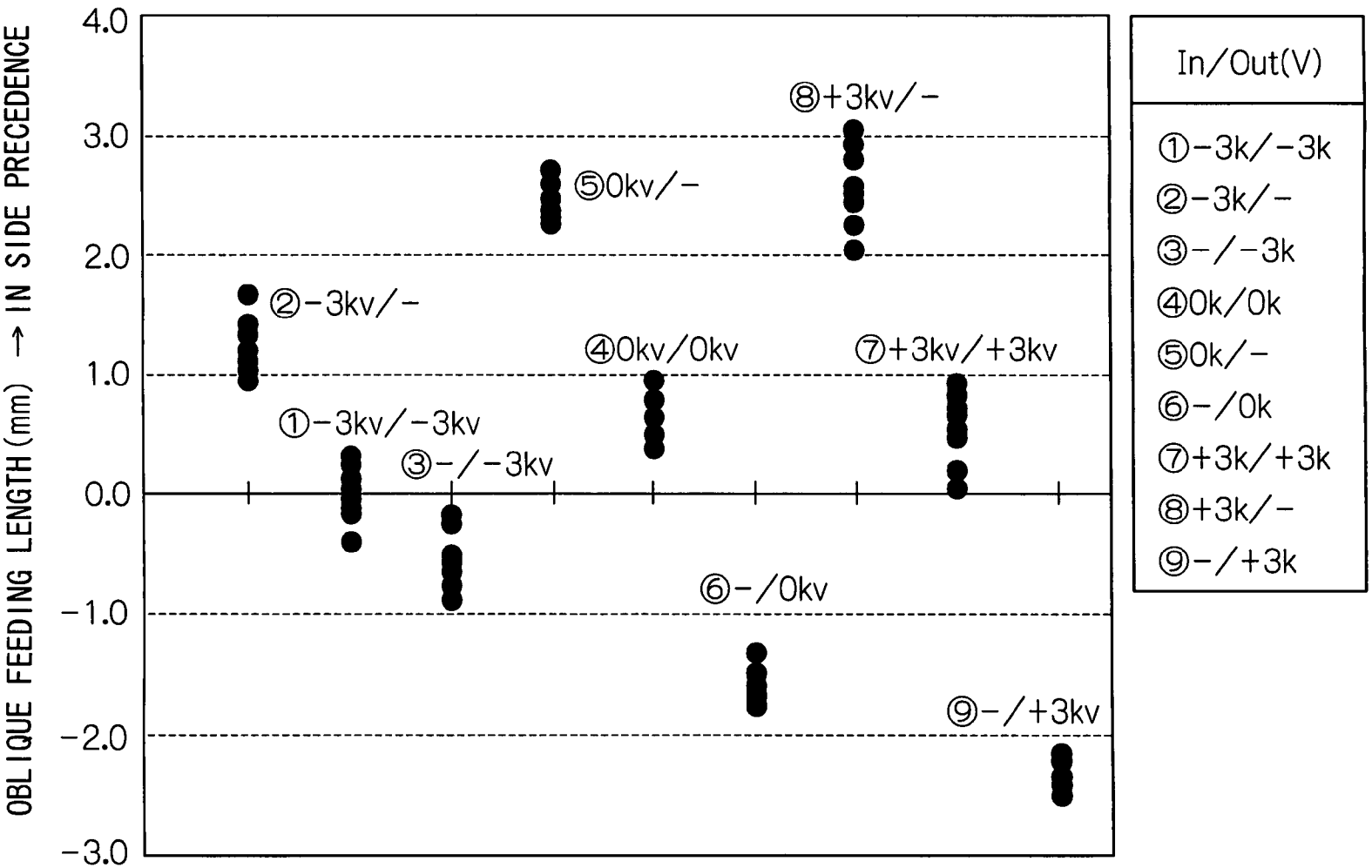
FIG. 9 is a graph showing relation between skew of the recording paper and a voltage applied to a needle-shaped discharge member on IN side and OUT side of the separating mechanism of the image forming apparatus according to the first exemplary embodiment of the invention.

FIG. 9 shows a result of experiment carried out to see the relation between the voltage applied to the needle-shaped discharge member 62 on the IN side and to the needle-shaped discharge member 64 on the OUT side and the skew length of the recording paper P. Note that "-" indicates a condition in which the needle-shaped discharge member 62 or 64 is floating (not connected to any item to which definite, controlled voltage is applied).

As evident from this graph, the skew length is small if the same voltage is applied to the IN side and OUT side. On the contrary, if the voltage applied to the IN side is changed while the OUT side is kept floating, preceding of the recording paper P at the IN side is increased in the order of −3 kV, 0 kV and +3 kV. Conversely, if the voltage applied to the OUT side is changed while the IN side is kept floating, the recording paper P is delayed at the IN side in the order of −3 kV, 0 kV and +3 kV (the preceding of the recording paper P at the OUT side is increased).

Thus, the control portion 12 controls the HV1 and HV2 so as to arrange voltages applied to the needle-shaped discharge members 62, 64 according to the difference between the detection timings of the jam detecting sensor 54 on the IN side and the jam detecting sensor 55 on the OUT side as described previously, thereby modifying the amount of the skew of the recording paper P after an image is transferred. Accordingly, transportation failure such as jam or wrinkle generated on the recording paper P in the fixing device 72 is suppressed. Further, because the skew of the recording paper P is corrected in the downstream side of the secondary transfer roller 42, the skew can be controlled without affecting toner image transfer performed by the transfer roller 42 and the intermediate transfer belt 14.

Further, because the jam detecting sensors 54, 55 function as skew amount detecting sensors, independent skew amount detecting sensor does not need to be provided. That is, a number of sensors decrease thereby leading to reduction in size and cost of the apparatus.

It is permissible to use a distance sensor for measuring a distance with respect to the recording paper P as the skew amount detecting sensor instead of using the jam detecting sensors 54, 55. In this case, it can be determined that a side having a smaller distance to the distance sensor in the width direction of the recording paper P precedes the other side of the recording paper P. If the distance with respect to the recording paper is infinitely far or there is a longer distance than a predetermined amount when reaching a predetermined timing, it can be determined that no recording paper P exists, that is, jam has been occurred.

Further, it is permissible to provide two image density detecting sensors 80 for detecting the density of an image in the width direction of the recording paper and use them as the skew amount detecting sensor. Alternatively, two image position detecting sensors for detecting the position of a toner image on the intermediate transfer belt, that is used in order to control the exposure timing of the exposing device 26, may be disposed at the same positions as the image density detecting sensors 80 and used as the skew amount detecting sensor. It is permissible to dispose the image density detecting sensors or the image position detecting sensors in the downstream side of the secondary transfer roller 42 in order to detect a toner image on the recording paper P after an image is transferred. Even with such structures, the image density detecting sensors or the image position detecting sensors can be used as the skew amount detecting sensors. Further, the jam detecting sensor (not shown) disposed in the upstream side of the secondary transfer roller 42 may be used as the skew amount detecting sensor. It is permissible to provide an independent skew amount detecting sensor separately. These sensors may also detect the passing heights of the recording paper P by acquiring a variation of the voltage level in the recording paper P.

Since the skew of the recording paper P after the image is transferred can be detected directly, the skew amount detecting sensor may be provided in the downstream side of the secondary transfer roller 42.

Next, a second exemplary embodiment of the invention will be described below. Like reference numerals are attached to the same components as the first exemplary embodiment and description of duplicated components is omitted.

Figure 3:
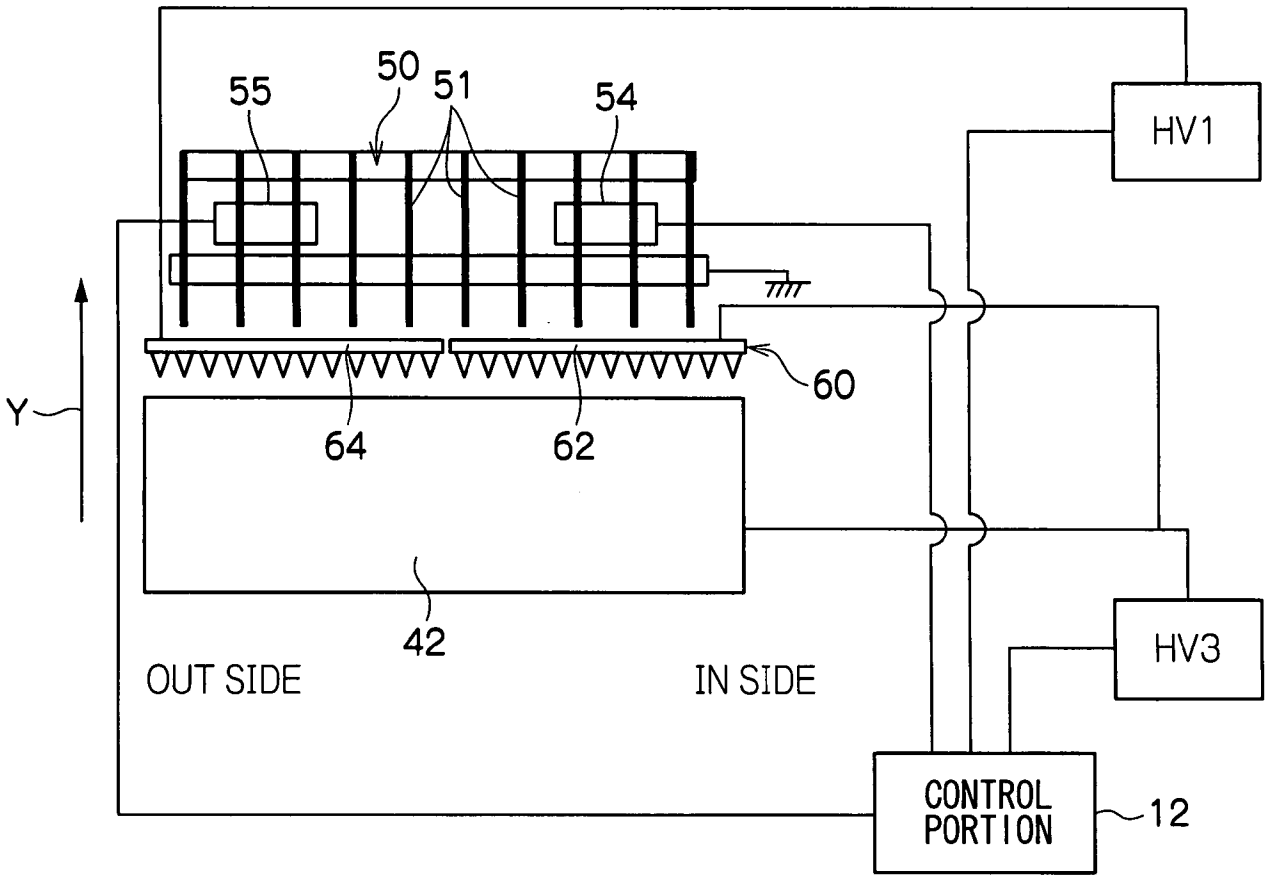
FIG. 3 is a front view showing schematically a separating mechanism of an image forming apparatus according to a second exemplary embodiment of the invention.

As shown in FIG. 3, a needle-shaped discharge member 62 on the IN side is applied a high voltage by a common high voltage power source HV3 that is also a power source for the secondary transfer roller 42. The control portion 12 modifies the skew by controlling a voltage applied from the HV1 to the needle-like discharge member 64 on the OUT side. With such a structure, one of the high voltage power sources can be eliminated (see FIGS. 2, 3).

If a voltage of HV3 applied to the secondary transfer roller 42 is changed due to atmospheric condition or aging of the roller 42, the voltage applied from the HV1 to the needle-like discharge member 64 on the OUT side is adjusted so as to correspond the voltage change of HV3.

Next, a third exemplary embodiment of the invention will be described. Like reference numerals and designations are attached to the same components as the first exemplary embodiment and duplicated description thereof is omitted.

Figure 4A:
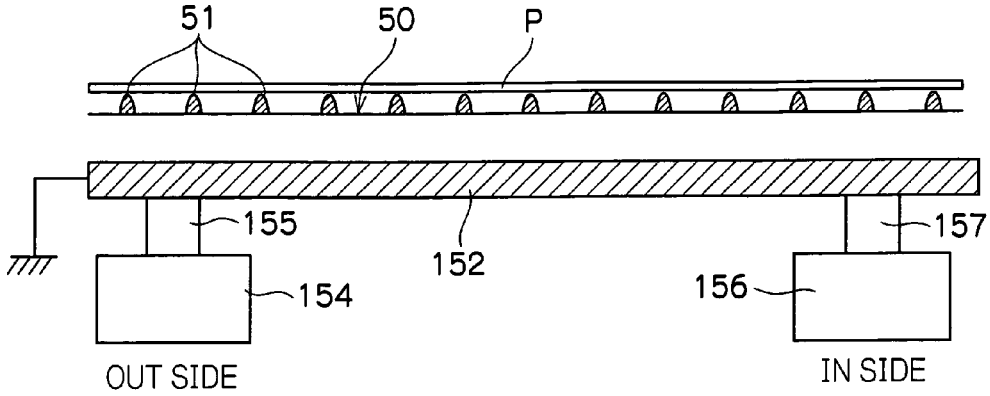
Figure 4B:
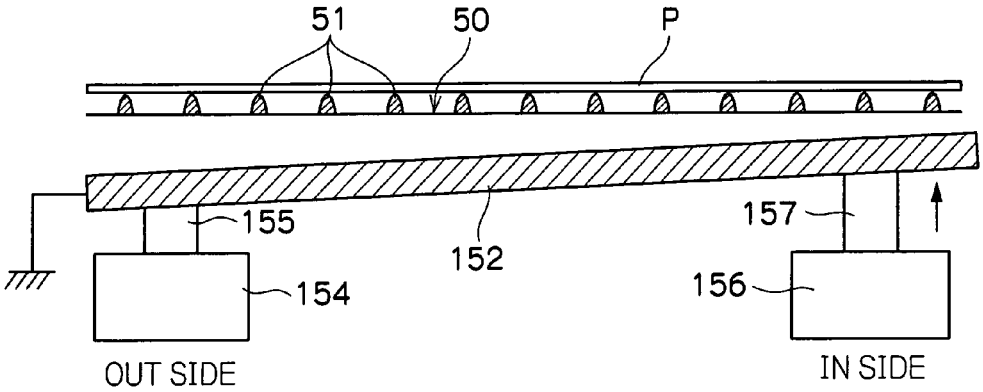
Figure 4C:
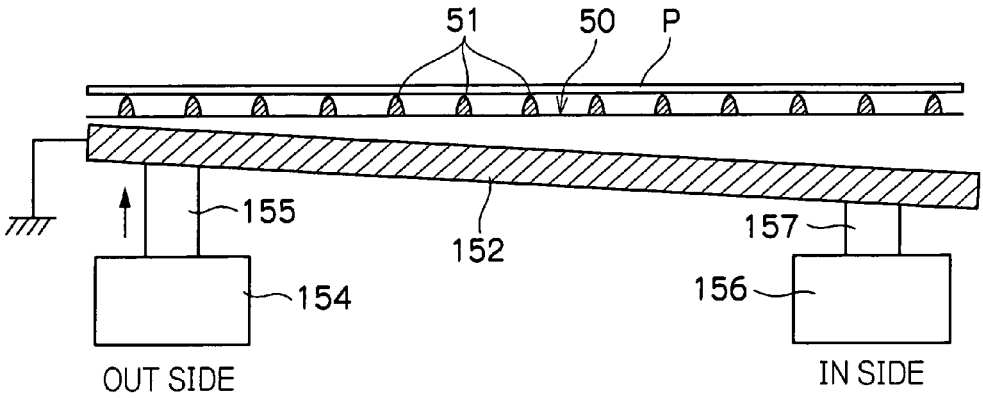

As shown in FIG. 4, the IN side and OUT side of a charge removal metal plate 152 are fixed to telescopic rods 155, 157 of actuators 154, 156. The actuators 154, 156 are controlled by the control portion 12. Each distance between the charge removal metal plate 152 and the recording paper P on the IN side and OUT side can be changed by moving the telescopic rods 155, 157 as shown in FIGS. 4B, 4C. A side of the recording paper P having a smaller distance to the charge removal metal plate 152 is carried in advance.

The control portion 12 changes respective distances at the IN side and OUT side between the charge removal metal plate 152 and the recording paper P by controlling the actuators 154, 156 according to the amount of the skew of the recording paper P so as to correct the skew of the recording paper P after an image is transferred.

Next, a fourth exemplary embodiment of the invention will be described. Like reference numerals and designations are attached to the same components and duplicated description thereof is omitted.

Figure 5:
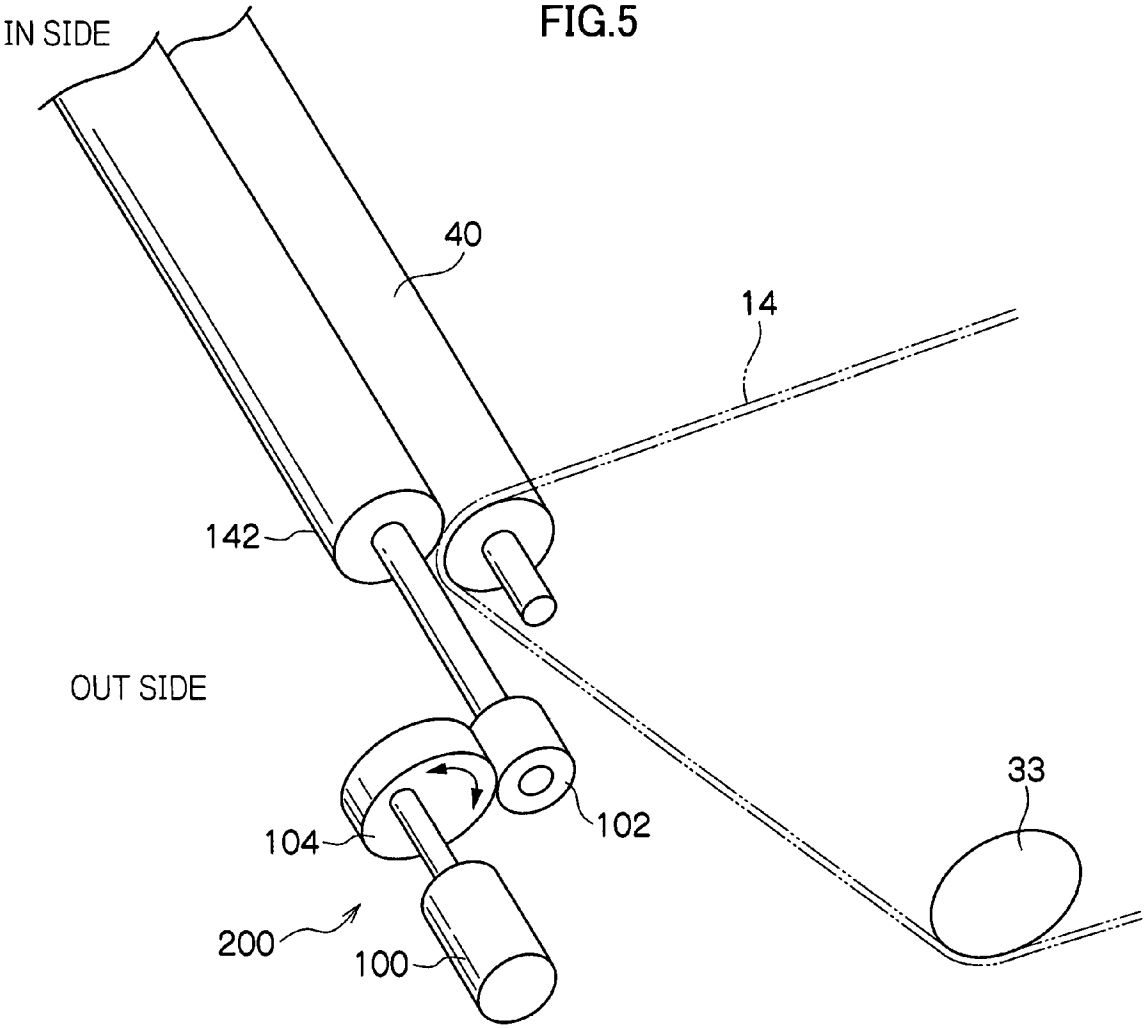
FIG. 5 is a diagram showing schematically a nipping pressure adjusting mechanism of an image forming apparatus according to a fourth exemplary embodiment of the invention.

As shown in FIG. 5, a secondary transfer roller 142 can differentiate nipping pressure between the IN side and OUT side with a nipping pressure adjusting mechanism 200.

The nipping pressure adjusting mechanism 200 has an eccentric cam 104 for pressing a bearing portion 102 provided at each end of the secondary transfer roller 142. A force (nipping pressure) for pressing the secondary transfer roller 142 to the intermediate transfer belt 14 (backup roller 40) can be adjusted by rotating the eccentric cam 104 with an adjustment motor 106. Pressure balance in the width direction of the secondary transfer roller 142 can be adjusted, that is, the nipping pressure on the IN side and OUT side of the secondary transfer roller 142 can be differentiated by changing pressing force between the IN side and OUT side by the eccentric cam 104. While FIG. 5 indicates only an end portion on the OUT side, an end portion on the IN side has the same structure. The adjustment motor 106 is also controlled by the control portion 12.

The skew of the recording paper P in the transporting direction thereof can be corrected by adjusting the pressure balance of the nipping pressure in the width direction of the secondary transfer roller 142. For example, if the nipping pressure on the IN side is increased while the nipping pressure on the OUT side is decreased, the IN side of the recording paper P is fed in advance.

The control portion 12 controls the nipping pressure adjusting mechanism 200 according to the amount of the skew of the recording paper P so as to correct the skew of the recording paper P after an image is transferred.

Next, a fifth exemplary embodiment of the invention will be described below. Like reference numerals and designations are attached to the same components as the first exemplary embodiment and duplicated description thereof is omitted.

Figure 6:
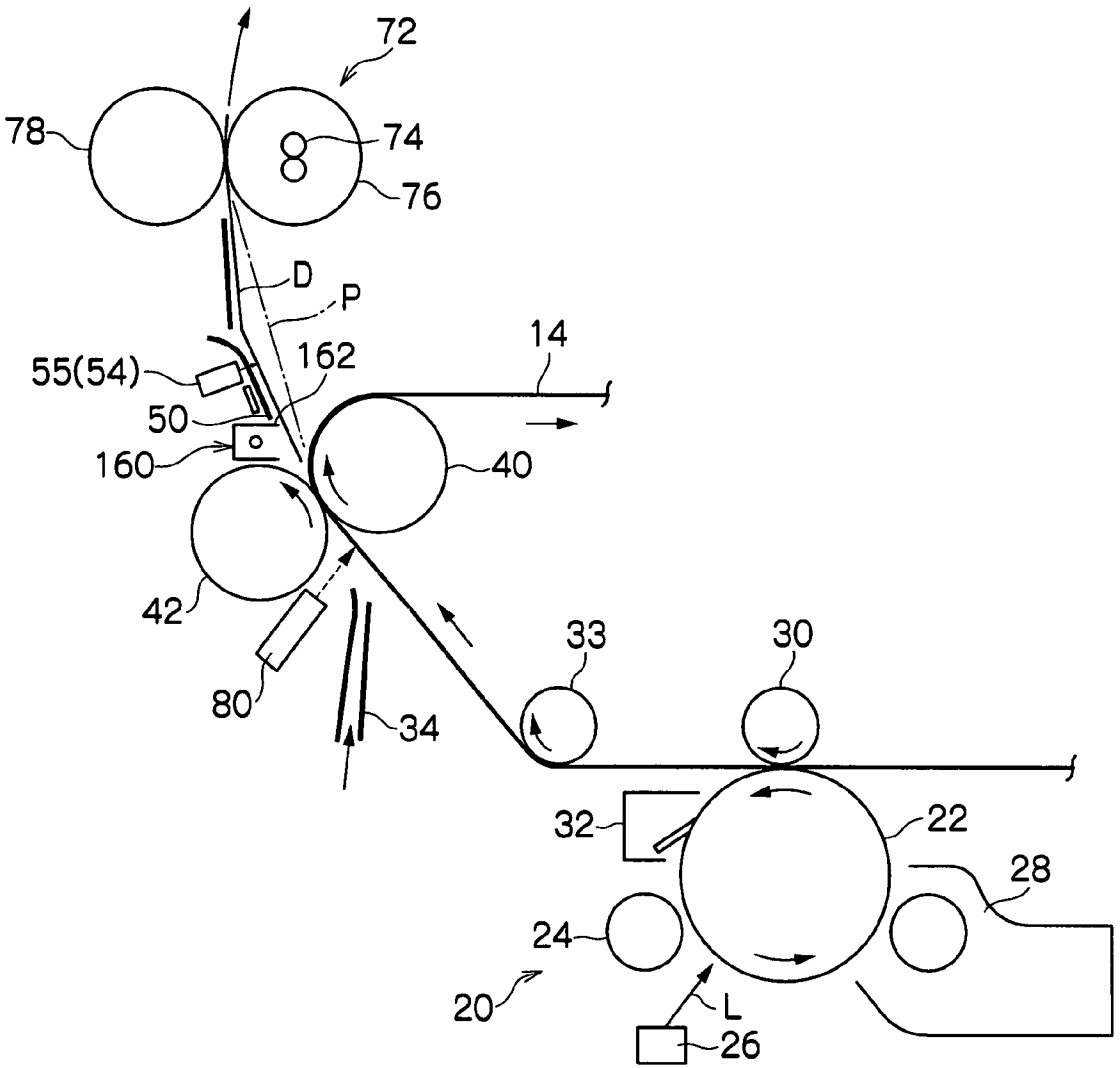
FIG. 6 is a partial side view schematically showing an image forming apparatus according to a fifth exemplary embodiment of the invention.

As shown in FIG. 6, a corotron 160 (corona discharger, (same as hereinafter)) which is a separating portion is provided between the guide member 50 and the secondary transfer roller 42.

Figure 7:
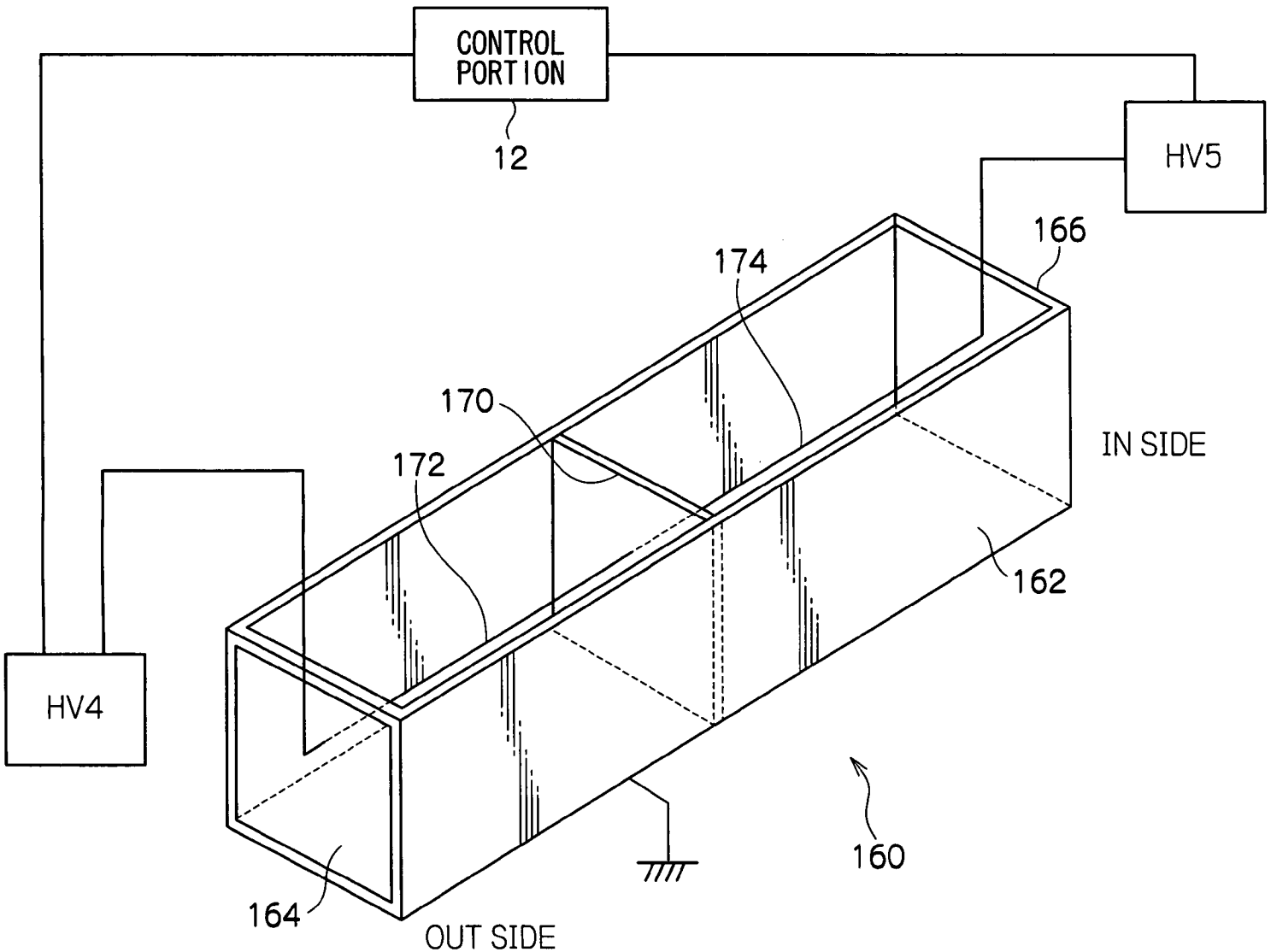
FIG. 7 is a diagram showing schematically a corotron (corona discharger) of an image forming apparatus according to a fifth exemplary embodiment of the invention.

As shown in FIG. 7, the corotron 160 formed by bending a sheet metal has a groove-like (having a U-shaped section) shield electrode 162 in which a portion thereof facing a transport path of the recording paper P is open. The shield electrode 162 is grounded. Sheet members 164, 166 composed of insulator are provided to seal both ends of the shield electrode 162. Further, a sheet member 170 composed of insulator is provided in the center of the shield electrode 162.

Wires 172, 174 composed of fine wires of tungsten or stainless steel are stretched in the width direction perpendicular to the transporting direction of the recording paper P. The wire 172 is provided between the sheet member 164 on the OUT side and the sheet member 170 in the center, and the wire 174 is provided between the sheet member 166 on the IN side and the sheet member 170 in the center. The wires 172, 174 are electrically insulated from each other.

High voltages are applied from high voltage power sources HV4 and HV5 to the wires 172 and 174, respectively.

The control portion 12 computes the amount of the skew of the recording paper P from detection timings acquired by the jam detecting sensor 54 on the IN side and the jam detecting sensor 55 on the OUT side and controls the HV4 and HV5 according to the amount of the skew so as to adjust voltages applied to the wires 172, 174. As a consequence, different separation forces with respect to the recording paper P are provided at the IN side and OUT side of the corotron 160 so as to correct the skew of the recording paper P after an image is transferred.

The several exemplary embodiments of the invention has been described however, the invention is not restricted to the above-described exemplary embodiments.

In the above-described exemplary embodiments, an image carrying body is a band-like intermediate transfer belt 14 however, it may be an intermediate transfer drum constructed into a cylindrical configuration. Alternatively, it is permissible to employ a structure for transferring an image from the belt-like or drum-like photosensitive part to the recording paper not through the intermediate transfer belt 14 or the intermediate transfer drum and in such a case, the image carrying body is a photosensitive part.

What is claimed is:

1. An image forming apparatus comprising:

an image forming portion that forms a toner image on an image carrying body;

a transfer portion that transfers the toner image formed on the image carrying body to a recording medium;

a detector that detects at least one of a skew and a passing position of the recording medium; and a controller that is provided downstream of the transfer portion in a recording medium transporting direction and controls at least one of the skew and the passing position of the recording medium according to a detection result by the detector, wherein the controller is a charge removal metal plate that removes charge from the recording medium and according to a detection result by the detector the charge removal metal plate controls at least one of the skew and the passing position of the recording medium by providing different distances between the charge removal metal plate and the recording medium in a width direction of the recording medium, the width direction being a direction that is substantially perpendicular to the transporting direction of the recording medium.

2. The image forming apparatus of claim 1, wherein the detector is disposed downstream of the transfer portion in the transporting direction of the recording medium.

3. The image forming apparatus of claim 1, wherein the detector comprises a plurality of detecting sensors provided in a width direction of the recording medium, the width direction being substantially perpendicular to the transporting direction of the recording medium, and detects at least one of the skew and the passing position of the recording medium by acquiring at least one of a passing timing of the lead edge of the recording medium in the transporting direction of the recording medium and a variation in voltage level of the recording medium.

4. The image forming apparatus of claim 3, wherein the plurality of detecting sensors also serves as an image position detecting sensor that detects the position of a toner image formed on the image carrying body or the recording medium.

5. The image forming apparatus of claim 3, wherein the plurality of detecting sensors also serves as an image density detecting sensor that detects the density of a toner image formed on the image carrying body or the recording medium.

6. The image forming apparatus of claim 3, wherein the plurality of detecting sensors also serves as a jam detecting sensor that detects a jam of the recording medium.

7. An image forming apparatus comprising:

an image forming portion that forms a toner image on an image carrying body;

a transfer portion that transfers the toner image formed on the image carrying body to a recording medium;

a detector that detects at least one of a skew and a passing position of the recording medium; and a controller that is provided downstream of the transfer portion in a recording medium transporting direction and controls at least one of the skew and the passing position of the recording medium according to a detection result by the detector, wherein the controller is a separating portion that separates the recording medium from the image carrying body and according to a detection result by the detector the separating portion controls at least one of the skew and the passing position of the recording medium by providing a difference in separation force of the separating portion in a width direction of the recording medium, the width direction being a direction that is substantially perpendicular to the transporting direction of the recording medium.

8. The image forming apparatus of claim 7, wherein the separating portion is a discharger having substantially needle shaped members to which a voltage has been applied and the discharger controls at least one of the skew and the passing position of the recording medium by providing a difference in applied voltage of the discharger in the width direction of the recording medium.

9. The image forming apparatus of claim 8, wherein a plurality of the dischargers each having substantially needle shaped members are provided in the width direction of the recording medium, and a power source of voltage applied to any one of the plurality of the dischargers is common to a power source of voltage applied to the transfer portion.

10. The image forming apparatus of claim 7, wherein the separating portion is a corona discharger comprising a wire and a shield electrode and the corona discharger controls at least one of the skew and the passing position of the recording medium by providing a difference in the applied voltage of the wire.

11. The image forming apparatus of claim 2, wherein the detector is disposed downstream of the transfer portion in the transporting direction of the recording medium.

12. The image forming apparatus of claim 2, wherein the detector comprises a plurality of detecting sensors provided in a width direction of the recording medium, the width direction being substantially perpendicular to the transporting direction of the recording medium, and detects at least one of the skew and the passing height of the recording medium by acquiring at least one of a passing timing of the lead edge of the recording medium in the transporting direction of the recording medium and a variation in voltage level of the recording medium.

13. The image forming apparatus of claim 12, wherein the plurality of detecting sensors also serves as an image position detecting sensor that detects the position of a toner image formed on the image carrying body or the recording medium.

14. The image forming apparatus of claim 12, wherein the plurality of detecting sensors also serves as an image density detecting sensor that detects the density of a toner image formed on the image carrying body or the recording medium.

15. The image forming apparatus of claim 12, wherein the plurality of detecting sensors also serves as a jam detecting sensor that detects a jam of the recording medium.

16. An image forming apparatus comprising:

an image forming portion that forms a toner image on an image carrying body;

a transfer roller that transports a recording medium by nipping together with the image carrying body, and transfers the toner image formed on the image carrying body to the recording medium;

a nipping pressure adjusting portion that provides different nipping pressures of the transfer roller in a width direction of the recording medium, the width direction being a direction that is substantially perpendicular to a transporting direction of the recording medium;

a detector that detects at least a skew and a passing position of the recording medium; and the nipping pressure adjusting portion adjusting the nipping pressure according to a detection result by the detector.

17. The image forming apparatus of claim 16, wherein the detector is disposed downstream of the transfer portion in a transporting direction of the recording medium.

18. The image forming apparatus of claim 16, wherein the detector comprises a plurality of detecting sensors provided in the width direction of the recording medium, and detects at least one of the skew and the passing position of the recording medium by acquiring at least one of a passing timing of the lead edge of the recording medium in the transporting direction of the recording medium and a variation in voltage level of the recording medium.

19. The image forming apparatus of claim 18, wherein the plurality of detecting sensors also serves as an image position detecting sensor that detects the position of a toner image formed on the image carrying body or the recording medium.

20. The image forming apparatus of claim 18, wherein the plurality of detecting sensors also serves as an image density detecting sensor that detects the density of a toner image formed on the image carrying body or the recording medium.

21. The image forming apparatus of claim 18, wherein the plurality of detecting sensors also serves as a jam detecting sensor that detects a jam of the recording medium.

* * * * *